United States Patent [19]

Mears, Jr.

[11] 4,153,651

[45] May 8, 1979

[54] CARBURETION BY EVAPORATION AND OSMOSIS

[76] Inventor: Donald B. Mears, Jr., 31 Locke Dr., Enfield, Conn. 06082

[21] Appl. No.: 930,991

[22] Filed: Aug. 4, 1978

[51] Int. Cl.[2] ..... F02M 17/24

[52] U.S. Cl. ..... 261/55; 261/105; 261/107; 261/DIG. 6

[58] Field of Search ..... 261/55, 105, 107, 104, 261/99, 96, DIG. 6

[56] References Cited

U.S. PATENT DOCUMENTS

| | | | |
|---|---|---|---|
| 156,820 | 11/1874 | Reed | 261/107 |
| 801,044 | 10/1905 | Parsons | 261/107 |
| 1,073,727 | 9/1913 | Atwood | 261/107 |
| 1,369,250 | 2/1921 | Landis | 261/104 |
| 1,369,775 | 3/1921 | Bliss | 261/104 |
| 1,640,291 | 8/1927 | Perkins | 261/107 |
| 1,755,011 | 4/1930 | Ludlam | 261/104 |
| 1,769,072 | 7/1930 | Raney | 261/104 |
| 2,323,721 | 7/1943 | McLindon | 261/107 |
| 3,336,734 | 8/1967 | Schultz | 261/96 |
| 3,892,547 | 7/1975 | Tucker | 261/96 |

FOREIGN PATENT DOCUMENTS

| | | | |
|---|---|---|---|
| 93446 | 11/1938 | Sweden | 261/99 |
| 772736 | 4/1957 | United Kingdom | 261/99 |

*Primary Examiner*—Tim R. Miles

[57] ABSTRACT

This invention is concerned with carburetion of gasoline for the purpose of reducing the consumption of gasoline and preventing pollution. The procedure for carrying out this function is by evaporation and osmosis. In the lower chamber of the carburetor where the liquid gasoline is located are immersed a plurality of special tubes. The tubes have in their lower portion on the inside surface an absorbant material, and wicks extending therefrom. In the upper portion of the tubes where the wicks are located, there are a plurality of lateral openings. The gasoline is located in a lower chamber where the tubes are immersed. The upper portion of the tubes are not immersed in the gasoline. When the motor is turned on, the intake valve opens and air is drawn through the air filter in the carburetor and down into the tubes. The air contacts the wicks in the tubes, vapor is formed, and passes through the openings thereof into a chamber which has a protective material located therein. From this chamber, the vapors of gasoline pass into the intake tube and are metered by the butterfly valve for delivery to the manifold and distribution to the cylinders of the engine. There is also provided a valve in proximity to the intake arrangement to insure the release of any back pressure which develops during a backfire. This valve is designed to open automatically and release the pressure so as to prevent damage within the carburetor.

17 Claims, 3 Drawing Figures

Fig. 1
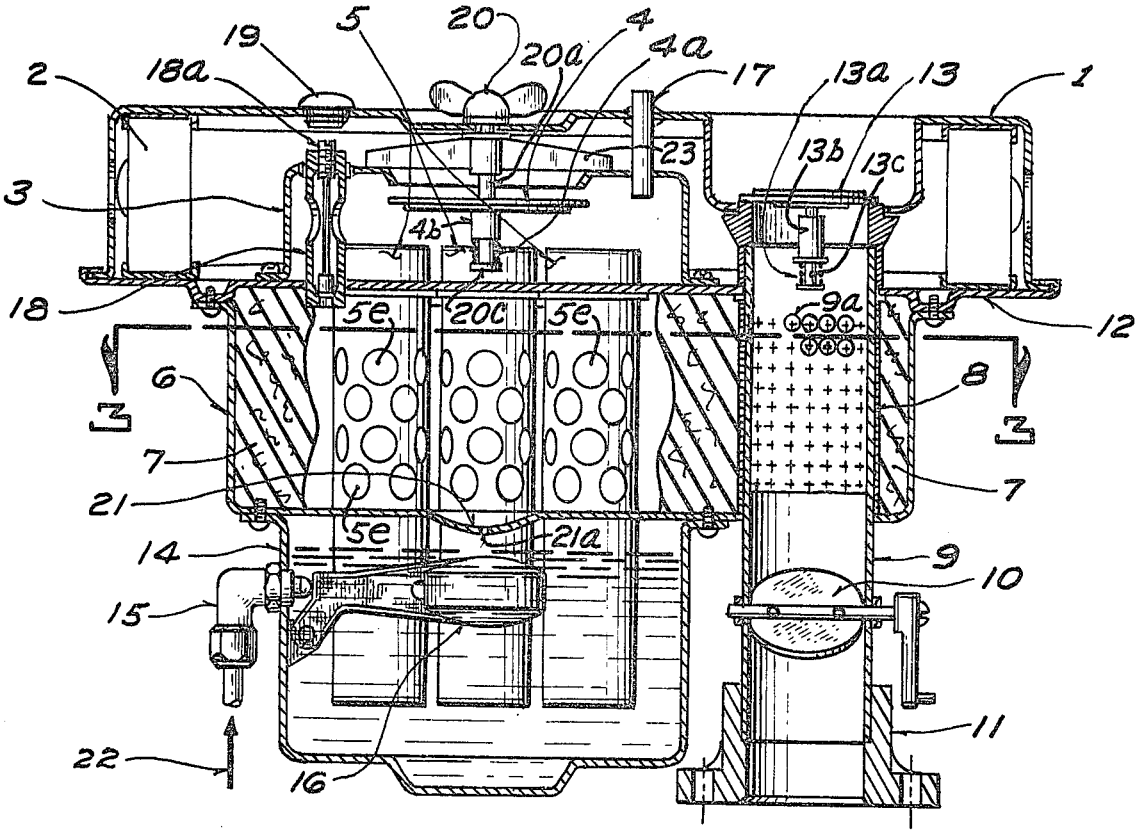
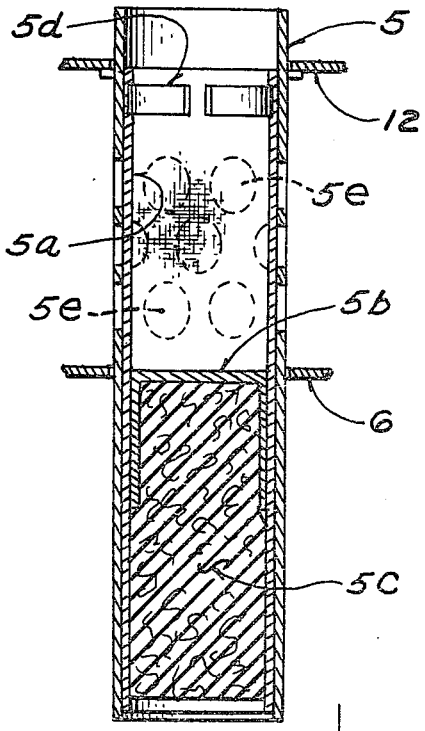
Fig. 2
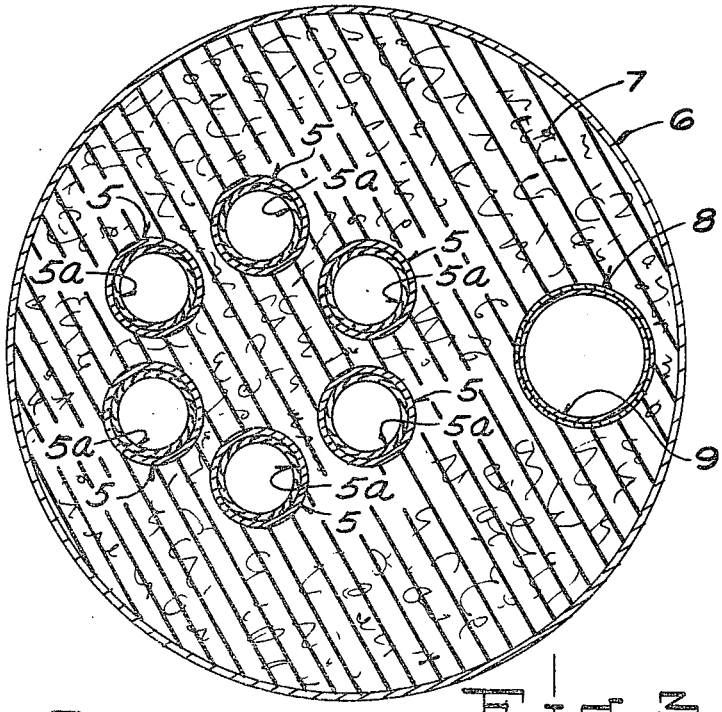
Fig. 3

CARBURETION BY EVAPORATION AND OSMOSIS

This invention is concerned with a carburetor and a principle for use in carburetion in order to save the consumption of gasoline, particularly where same is used with internal combustion engines.

Most carburetors that are in use today have mechanically combined liquid gasoline, and air in a metered controled manner to form a gasoline vapor, which undergoes combustion when ignited within the combustion chamber of the engine. This produces, of course, the explosion and the force to move the pistons within the cylinders and turn the crankshaft. Most of these devices have been somewhat inefficient even with improvements. Attempts have been made to use superchargers and pre-vaporizers to make the carburetion work more efficiently.

However, there was always a rich mixture, particularly under certain operating conditions.

These prior attempts at carburetion either have the inability to meter and mix properly the air and the liquid gasoline, to form a balanced vapor free of liquid gasoline particles, which remain unburned during combustion, and are expelled in the engine exhaust system as a hydrocarbon pollution. This result requires a complex and power depleting anti-pollution device to be added to the exhaust system of the engine to conform to environmental law.

It is the purpose of this invention to solve the basic problem of producing a properly balanced gasoline vapor, which is free of the liquid gasoline particles that are not burned during combustion, thereby reducing fuel consumption and pollution.

The carburetion system of the within invention is a non-force method to form the gasoline vapor through natural evaporation.

The basic idea of using naturally formed gasoline vapor to energize an internal combustion engine is not a new concept. There have been attempts in the early development stages of the internal combustion engine to perform this function.

The results were very unsatisfactory and in some instances, disasterous. If the engine misfired or backfired, the vapor in the system would ignite back through the vapor lines to the gasoline tank and cause an explosion. These explosions had the power of one or two sticks of dynamite.

For the obvious reasons of safety, the idea was quickly abandoned. The present day concept of mixing the liquid gasoline with air prior to entering the engine became the more popular approach, and has been uniformly adopted and used with only minor design changes.

The salient fact still remains that the gasoline vapor formed through the natural evaporation process provides the optimum combustable mixture. The reason for this statement is that the air will only absorb gasoline molecules until the air becomes saturated. Therefore, no liquid gasoline will be in the vapor when the combustion takes place. The end result will be a reduction in hydrocarbon pollution in the exhaust from the engine, and also a reduction in liquid fuel consumption.

It is the purpose of the within invention to provide a carburetion system that will reduce the liquid fuel consumption and reduce the hydrocarbon pollution.

It is also an object of the within invention to provide a carburetion system, which, when attached to the engine, will be safe in the event of backfiring and will be efficient, inexpensive to manufacture, and reliable under all types of weather conditions.

It is a further object of the within invention to provide a carburetion system that may be used to replace existing carburetion systems in use with the existing internal combustion engines in most motor vehicles.

These and other objects may be ascertained and understood by reference to the following detailed description and to the encompanying drawings in which:

FIG. 1 is a diagramatic, sectional view in elevation of the carburetor.

FIG. 2 is a side view in elevation of the evaporation tube in cross-section.

FIG. 3 is a cross-section view of the carburetor shown in FIG. 1 taken along Lines 3—3.

In the carburetor of FIG. 1, the air filter or inlet valve cover 1, having a circular shape, is located above the other components. Beneath the cover 1 is the air filter 2. The air filter 2 is conventional. There is an inlet valve body 3 located in proximity to the air filter 2, and valve body 3 is fastened to the vapor chamber cover 12. Within the inlet valve body 3 is located an inlet valve 4, which, in FIG. 1, is shown in open position. There is an inlet valve spring **4*a* which operates with the inlet valve 4 to move the inlet valve 4 into position at the opening in the inlet valve body 3 beneath the wing nut 20. The wing nut 20 is mounted on the shaft 20*a* about which the inlet valve spring 4*a* is circumscribed and which is the support member for the inlet valve body 3. There is above the spring 4*a* a valve bushing 4*b* circumscribing shaft 20*a*, protruding outwardly from the shaft 20*a*, so that the spring 4*a* is locked into position between said bushing 4*b* and the retaining flange 20*c*. There is also a support bracket 23 located beneath the wing nut 20 circumscribing the shaft 20*a*. The support bracket 23 is fastened to the inlet valve body 3**.

There are a plurality of cylindrical evaporation tubes 5 shown. The upper portion of the tubes 5 extend above the liquid chamber 14 and the lower portions of the tubes are immersed into the liquid gasoline, which is located in the liquid chamber 14. A tube 5 can be seen in cross-section in the view of FIG. 2. The evaporation tubes 5 include a circular wick **5*a*, a liquid seal 5*b*, a liquid absorbing packing 5*c*, and a retainer clip 5*d*. The upper portion of tubes 5 extend into the vapor chamber 6. In the vapor chamber 6 there is located an open pore plastic foam 7**, having specifications of approximately 60 pores per inch, maximum.

On the right hand side of FIG. 1 is located a backfire screen 8. The screen 8 is located proximate the intake tube 9. The intake tube 9 houses, in the conventional manner, the butterfly assembly 10, otherwise referred to as the control valve 10. The intake tube 9 is secured to the manifold by attachment to the manifold connecting flange 11. To the right of the backfire screen 8 in the view of FIG. 1 is the vapor chamber cover 12. Above the intake tube 9 is the backfire valve 13 shown in a closed position. There is a backfire valve spring **13*a* circumscribing the shaft 13*c*, which has a bushing 13*b*, which is secured within intake tube 9, and a retainer cap 13*d***.

Reference is now made to FIG. 1 (lower left hand side), wherein a liquid shutoff valve 15 is located and is connected to the liquid chamber 14. This valve 15 controls the amount of the gasoline 22 from its source. In the conventional motor vehicle, valve 15 is connected by tubing usually through a gasoline filter in a circuit with a fuel pump to the gasoline tank. There is located in this invention a liquid cutoff valve or shutoff valve float 16 which, when it reaches the elevation shown, in FIG. 1, will cause the valve 15 to become closed, and thereby prevents the entry of excessive liquid gasoline into the chamber 14. This particular shutoff valve 15 and its function is conventional in most carburetors.

At the upper portion of FIG. 1, there is located a gas tank vapor return fitting 17, which is cylindrical and hollow. The hollow cylindrical gas tank vapor return fitting 17 is connected to a tube which runs to the top of the gasoline tank. This captures the vapors that are produced by the evaporation within the gasoline tank. These vapors flow into the tube 17, and are thereby transmitted from the tube 17 into the chamber formed by the valve inlet body 3. The vapors that enter through this particular return fitting 17 are contained, and mixed with the air that is supplied to accomplish the evaporation process of the carburetion system. This particular concept is to satisfy emission problems and to comply with environmental law so that the gasoline vapors will not enter the atmosphere and will be contained within the system.

In the upper portion of FIG. 1 on the left side, there is located an air valve adjusting screw 18*a*, which is connected to the top of the air valve assembly 18. There is also a cap 19 above this adjusting screw 18*a* located in the cover 1. If it is desired to use additional air to balance the system, the cap 19 is removed and a screwdriver can be inserted through that opening in the cover 1 to turn and adjust the air valve adjusting screw 18*a* until the correct amount of air is mixed into the carburetion system for the purpose of balancing same.

It is within the contemplation and spirit of this invention that the adjustment at 18*a* may be controlled by an electronic balancing system. The evaporation chamber 6 has a lower portion which has a concave area 21. This permits gasoline vapors that have condensed into liquid to collect in that area. There is a small opening at 21*a* whereby the said liquid gasoline that is condensed from the vapors may flow down into the gasoline chamber 14.

In operation, the carburetor works as follows:

The gasoline enters, as previously stated, from the source 22 into the liquid shutoff valve 15 and into the gasoline or liquid chamber 14. There is also, as stated, gasoline entering at 17 in the nature of vapors. These vapors will collect in the chamber formed by the vapor chamber cover 12 and the inlet valve body 3. These vapors either mix with the incoming air supplied to perform the process of evaporation when mixed with the liquid gasoline in the wicks 5*a* of the various tubes 5, or, if the motor is not running, they will be contained within the chamber formed by the closed inlet valve 4, and the inlet valve body 3. Once the proper amount of liquid gasoline has been located in the liquid chamber 14, the shutoff valve float 16 will actuate shutoff valve 15 and prevent further gasoline from entering the system. The process of evaporation will now start to take place. The liquid fuel is absorbed by the liquid absorbing packing at 5*c*. This packing 5*c* now becomes saturated, and the process known as osmosis takes place. This osmosis occurs because on the inside of the tubes 5 are the wicks 5*a*, which circumscribe the internal cylinder of the tube 5 and absorbs gasoline upwardly inside the empty portion of the upper area of the tubes 5.

We have to go back now slightly to explain the cycle of operation.

When the motor is turned over by the conventional starter system, a vacuum is created, by the downward stroking of the pistons within the cylinder. This is known as the intake stroke. When this vacuum is formed, it draws air through the air filter 2, the open inlet valve 4 and down into the upper portion of the tubes 5. This air mixes with the liquid gasoline as it passes through the wicks 5*a* and through the openings 5*e* into the vapor chamber 6. A vapor is formed thereby and passes into the open pore plastic foam, material 7, which has been provided in order to safely contain the vapor and prevent any volatile combustion. The air, during this moment of the intake cycle, passes through the wick 5*a*, which has been saturated by the liquid gasoline by the aforesaid process, and then becomes vapor and enters into the porous material 7 within the evaporation chamber 6. The vapor now passes through the backfire screen 8. There are openings 9*a* located in the intake tube 9. Once the vapors enter into these openings 9*a*, they pass down into the area where the butterfly valve 10 is located. The butterfly valve 10 will be open in the conventional manner and the gasoline vapors that have been formed by the process described will now enter into the intake manifold for the purpose of being distributed to the various cylinders for the combustion cycle.

In the event that the vapors in the intake tube 9 are ignited, by a backfire or missfire, the backfire valve 13 will open automatically and release any excessive pressure to insure that the explosion will not damage the carburetor. This is a safety device that opens only when the internal components of the engine are not functioning properly. Normally, the valve 13 remains closed because no positive pressure exists in the manifold when the engine is working correctly. The sump area 21 is provided in the vapor chamber 6 to collect the liquid gasoline which may form from the condensation of gasoline vapors trapped in the vapor chamber 6 while the engine is not running, the opening 21*a* allows the liquid gasoline to return to the liquid chamber 14 below for reuse when the engine is running.

I claim:

1. A carburetion system utilizing absorption, osmosis, and evaporation for energizing an engine comprising a lower liquid gasoline chamber having gasoline therein, an air chamber, an air intake valve, an inlet to said lower chamber from a source of liquid gasoline, an upper vapor chamber above said lower liquid chamber, a plurality of tube means open at each end thereof, absorbant material located in the lower portion of said tubes and in contact with said gasoline in said lower chamber, a wick circumscribing the interior surface of said tubes the length thereof, and in contact with said absorption material, a plurality of openings above the lower chamber in the periphery of said tubes, said upper vapor chamber having porous material surrounding the openings in said tubes therein, the upper portion of said tubes extending through said upper vapor chamber and in communication with the air intake valve, whereby the gasoline is absorbed in the absorption material and is carried by the process of osmosis in the wicks and whereby when air passes through the air valve and contacts the wicks in the tubes, the liquid gasoline changes into a vapor, and the vapor infiltrates the porous material in the vapor chamber through the opening in the tubes, said liquid gasoline evaporating when the air passes through the saturated wicks.

2. A carburetion system described in claim 1 having a control valve, conduit means for connecting said control valve to an engine, an intake means, said intake means having openings thereon whereby said vapor passes from said vapor chamber into said intake means, and when said control valve is open, the vapors are delivered by said conduit means to energize an engine.

3. A carburetion system described in claim 2, having a backfire valve means, said backfire valve means located above said intake valve and within the conduit means to the engine whereby when there is back pressure, the backfire valve means will open and release the back pressure.

4. A carburetion system described in claim 1 having a means for permitting gas vapors from the gasoline source to enter the vapor chamber, a sump in the bottom of said vapor chamber, an opening in said sump, whereby said vapors either mix with the other vapors in the vapor chamber, or become condensed and return to their liquid state and drop into the lower chamber by the forces of gravity.

5. A carburetion system described in claim 2 having a means for permitting gas vapors from the gasoline source to enter the vapor chamber, a sump in the bottom of said vapor chamber, an opening in said sump, whereby said vapors either mix with the other vapors in the vapor chamber, or become condensed and return to their liquid state and drop into the lower chamber by the forces of gravity.

6. A carburetion system described in claim 3 having a means for permitting gas vapors from the gasoline source to enter the vapor chamber, a sump in the bottom of said vapor chamber, an opening in said sump, whereby said vapors either mix with the other vapors in the vapor chamber, or become condensed and return to their liquid state and drop into the lower chamber by the forces of gravity.

7. A carburetion system as described in claim 1 having a liquid shutoff valve means, said liquid shutoff valve means having a float therein, said float immersed in the gasoline located in the gasoline chamber means for connecting said shutoff valve means to the inlet from the source of gasoline, whereby the amount of gasoline in said gasoline chamber is controlled and shut off at a predetermined position of said float.

8. A carburetion system as described in claim 2 having a liquid shutoff valve means, said liquid shutoff valve means having a float therein, said float immersed in the gasoline located in the gasoline chamber means for connecting said shutoff valve means to the inlet from the source of gasoline, whereby the amount of gasoline in said gasoline chamber is controlled and shut off at a predetermined position of said float.

9. A carburetion system as described in claim 3 having a liquid shutoff valve means, said liquid shutoff valve means having a float therein, said float immersed in the gasoline located in the gasoline chamber means for connecting said shutoff valve means to the inlet from the source of gasoline, whereby the amount of gasoline in said gasoline chamber is controlled and shut off at a predetermined position of said float.

10. A carburetion system as described in claim 4 having a liquid shutoff valve means, said liquid shutoff valve means having a float therein, said float immersed in the gasoline located in the gasoline chamber means for connecting said shutoff valve means to the inlet from the source of gasoline, whereby the amount of gasoline in said gasoline chamber is controlled and shut off at a predetermined position of said float.

11. A carburetion system as described in claim 5 having a liquid shutoff valve means, said liquid shutoff valve means having a float therein, said float immersed in the gasoline located in the gasoline chamber means for connecting said shutoff valve means to the inlet from the source of gasoline, whereby the amount of gasoline in said gasoline chamber is controlled and shut off at a predetermined position of said float.

12. A carburetion system as described in claim 1 having an air adjusting means adjacent said air intake valve for controlling the volume of air passing therethrough to the vapor chamber whereby the air entering the vapor chamber can be adjusted to atmospheric conditions and the like to maintain peak efficiency in the vaporizing process.

13. A carburetion system as described in claim 2 having an air adjusting means in said air intake valve for controlling the volume of air passing therethrough to the vapor chamber whereby the air entering the vapor chamber can be adjusted to atmospheric conditions and the like to maintain peak efficiency in the vaporizing process.

14. A carburetion system as described in claim 3 having an air adjusting means in said air intake valve for controlling the volume of air passing therethrough to the vapor chamber whereby the air entering the vapor chamber can be adjusted to atmospheric conditions and the like to maintain peak efficiency in the vaporizing process.

15. A carburetion system as described in claim 4 having an air adjusting means in said air intake valve for controlling the volume of air passing therethrough to the vapor chamber whereby the air entering the vapor chamber can be adjusted to atmospheric conditions and the like to maintain peak efficiency in the vaporizing process.

16. A carburetion system as described in claim 5 having an air adjusting means in said air intake valve for controlling the volume of air passing therethrough to the vapor chamber whereby the air entering the vapor chamber can be adjusted to atmospheric conditions and the like to maintain peak efficiency in the vaporizing process.

17. A carburetion system as described in claim 6 having an air adjusting means in said air intake valve for controlling the volume of air passing therethrough to the vapor chamber whereby the air entering the vapor chamber can be adjusted to atmospheric conditions and the like to maintain peak efficiency in the vaporizing process.

* * * * *